US005650012A

United States Patent [19]

Davis

[11] Patent Number: 5,650,012

[45] Date of Patent: Jul. 22, 1997

[54] VARIABLE SPEED BOWLING LANE MAINTENANCE MACHINE

[75] Inventor: John M. Davis, Sebring, Fla.

[73] Assignee: The Kegel Company, Inc., Sebring, Fla.

[21] Appl. No.: 472,966

[22] Filed: Jun. 7, 1995

[51] Int. Cl.[6] ..... B05C 1/00

[52] U.S. Cl. ..... 118/681; 118/693; 118/694; 118/207; 118/260; 118/262; 118/268; 15/98; 15/103.5

[58] Field of Search ..... 118/207, 260, 118/262, 268, 681, 693, 694; 15/302, 320, 319, 98, 103.5, 50.3, 52, 52.1

[56] References Cited

U.S. PATENT DOCUMENTS

| | | | |
|---|---|---|---|
| 2,622,254 | 12/1952 | Mendelson . | |
| 2,893,047 | 7/1959 | Swihart . | |
| 3,083,390 | 4/1963 | Wroten . | |
| 3,216,036 | 11/1965 | Rockwood et al. . | |
| 3,729,769 | 5/1973 | Sharpless . | |
| 3,868,738 | 3/1975 | Horst et al. . | |
| 4,246,674 | 1/1981 | Ingermann et al. . | |
| 4,369,544 | 1/1983 | Parisi . | |
| 4,510,642 | 4/1985 | Ingermann et al. . | |
| 4,708,603 | 11/1987 | Kubo . | |
| 4,727,615 | 3/1988 | Kubo . | |
| 4,738,000 | 4/1988 | Kubo . | |
| 4,856,138 | 8/1989 | Ingermann et al. . | |
| 4,920,604 | 5/1990 | Ingermann et al. . | |
| 4,959,884 | 10/1990 | Ingermann et al. . | |
| 4,962,565 | 10/1990 | Ingermann et al. . | |
| 5,063,633 | 11/1991 | Ingermann et al. . | |
| 5,133,280 | 7/1992 | Kubo . | |
| 5,161,277 | 11/1992 | Ingermann et al. . | |
| 5,181,290 | 1/1993 | Davis et al. | 118/260 |
| 5,243,728 | 9/1993 | Smith et al. . | |
| 5,274,871 | 1/1994 | Smith et al. . | |

*Primary Examiner*—Laura Edwards
*Attorney, Agent, or Firm*—Hovey, Williams, Timmons & Collins

[57] ABSTRACT

A bowling lane maintenance machine is operable at different speeds for applying selected lane dressing profiles to the lane and for reducing the time required for performing lane maintenance, including cleaning. In the preferred machine, absorbent wicks are used to transfer lane dressing from a reservoir to an applicator assembly. Lane dressing is recycled through an overflow in the reservoir to maintain a constant level and thereby maintaining a constant transfer rate through the wicks. The preferred machine also includes a cleaning assembly for applying a cleaning liquid to the lane and removing the liquid into a spent liquid storage tank. A vacuum pump induces air flow through the cleaning assembly for removing spent cleaning liquid which subjects the liquid in the tank to foaming. A controller stops the vacuum pump for a selected time in order to allow the foam to settle and then restarts the pump.

8 Claims, 7 Drawing Sheets

Microfiche Appendix Included
(3 Microfiche, 148 Pages)

| |
|---|
| Fig. 12A |
| Fig. 12B |
| Fig. 12C |

VARIABLE SPEED BOWLING LANE MAINTENANCE MACHINE

MICROFICHE APPENDIX

A microfiche appendix containing a source code of a computer program useful in accordance with the present invention is appended hereto as 3 sheets of microfiche containing 148 frames.

BACKGROUND OF THE INVENTION

1. Field of the Invention

The present invention relates to the field of bowling lane maintenance machines for cleaning and oiling bowling lane surfaces. More particularly, the preferred machine is operable at a plurality of selectable speeds in order to apply a desired lane dressing pattern and to reduce maintenance time requirements. The preferred machine also maintains a selected level in the lane dressing reservoir and stops the vacuum pump for a selected time in order to reduce foaming in the spent cleaning liquid tank.

2. Description of the Prior Art

In the prior art, one type of bowling lane maintenance machine is electrically powered for traversing a bowling lane forwardly toward the pins and rearwardly toward the foul line. While traversing a lane, such a machine is operable for cleaning the surface of the lane using a detergent or solvent during the forward pass, and operable for applying lane dressing during the forward and rearward passes.

One of the prior art problems has been the lack of control over the application of lane dressing to achieve the desired pattern both in transverse profile and linearly. More particularly, prior art maintenance machines have had difficulty in applying enough lane dressing in a uniform manner. In such machines, wicks immersed in a lane dressing reservoir engage a transfer roller which in turn transfers lane dressing to an applicator roller in direct contact with the lane. In order to achieve higher application rates, one prior art solution has been to increase the speed of the transfer roller or applicator roller. This has resulted in a lack of uniformity of the lane dressing applied to the lane.

Another problem with the prior art has been the lack of uniform transfer of lane dressing through the wicks that engage the transfer rolling. As the wicks absorb lane dressing from the reservoir, the liquid level falls which reduces the transfer rate because less of the wick is immersed. It has been found that even small changes in the liquid level can adversely affect the uniformity of application to the bowling lane.

Prior art maintenance machines have also presented a problem in that they require frequent emptying of the tank that holds spent cleaning solution. A vacuum pump is used to create a partial vacuum into the tank which is coupled with a liquid removal assembly in contact with the lane. The partial vacuum induces an airflow in the removal assembly much like a vacuum cleaner to remove spent cleaning liquid from the lane. The airflow through the tank and the partial vacuum therein causes the spent cleaning solution to foam thereby reducing the effective holding capacity of the tank. The need to empty the tank frequently slows the process for cleaning all of the lanes in a bowling center, which can be a particular problem during tournaments.

Finally, prior art machines have not been able to maintain uniform application of lane dressing at very low levels. When a wick engages the transfer roller, the application of lane dressing exceeds the required low level, and when the wick disengages, the applicator roller rapidly depletes resulting in application below the desired level.

SUMMARY OF THE INVENTION

The bowling lane maintenance apparatus of the present invention solves the prior art problems discussed above and provides a distinct advance in the state of the art. More particularly, the invention hereof allows the application of uniform levels of lane dressing at both very high and very low rates of application. Furthermore, the invention ensures uniform transfer rates through the wicks and reduces the frequency of emptying the spent cleaning solution tank.

The preferred embodiment of the present invention includes a controller for operating a variable speed drive mechanism for propelling the maintenance apparatus at a plurality of selectable speeds during maintenance operations. In one preferred aspect, the apparatus is operated at a higher speed during rearward movement when lane dressing is not being applied, and at a lower speed for applying increased rates of lane dressing while keeping the transfer and applicator rollers at the same speed to ensure uniformity.

In one preferred aspect of the invention, the lane dressing reservoir includes an overflow outlet through which lane dressing continually overflows to maintain a constant level in the reservoir, and thereby maintaining a more uniform transfer rate through the wicks. In another aspect, the controller stops the operation of the vacuum pump for a selected time on the rearward pass in order to allow the foam to settle in the spent solution tank. Other preferred aspects of the present invention are set forth herein.

DETAILED DESCRIPTION OF THE PREFERRED EMBODIMENTS

Figure 1:
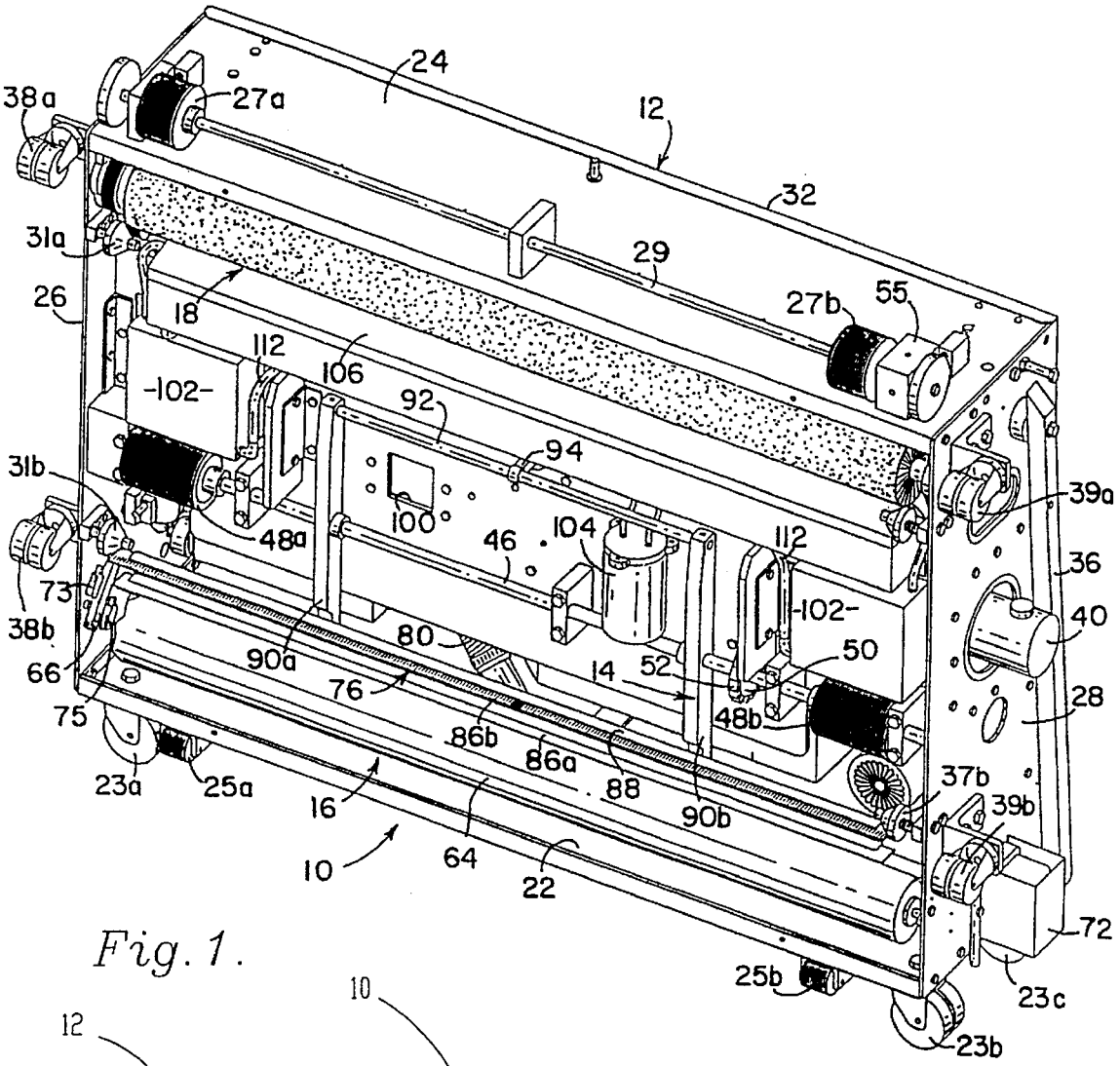
FIG. 1 is a bottom left perspective view of the preferred apparatus of the present invention.

The drawing figures illustrate the preferred embodiment of bowling lane maintenance apparatus 10 constructed in accordance with the present invention. Apparatus 10 broadly includes housing 12, drive system 14, cleaning assembly 16, lane dressing assembly 18 and control system 20.

Figure 2:
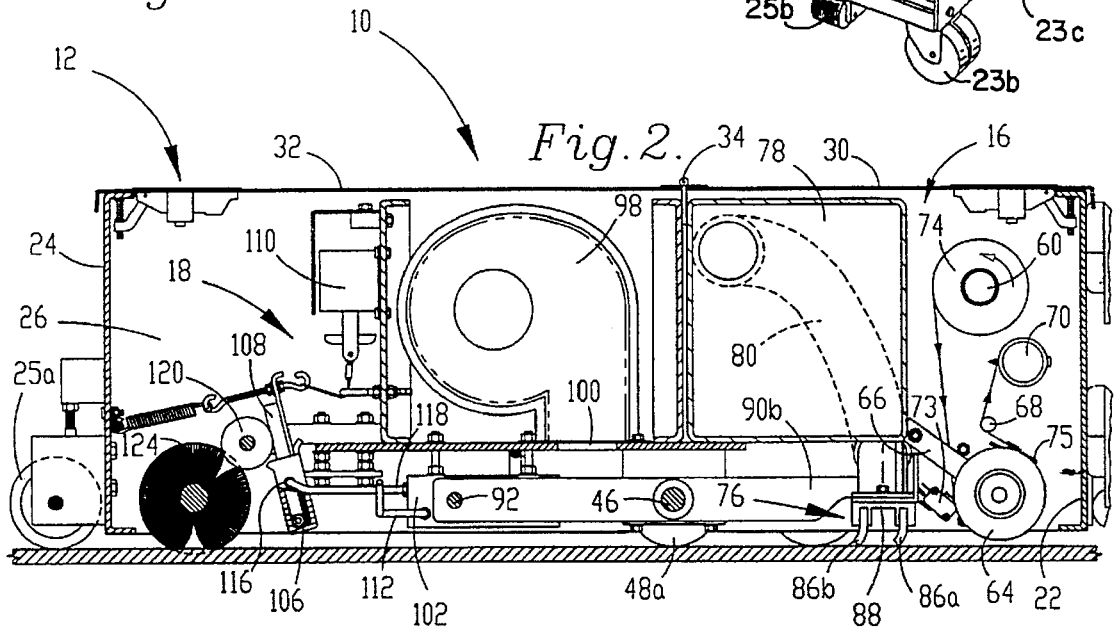
FIG. 2 is a sectional view of the apparatus of FIG. 1.

Referring to FIGS. 1 and 2, housing 12 includes front wall 22, rear wall 24, left side wall 26, right side wall 28, top front door 30 coupled with top rear door 32 by piano-type hinge 34, and U-shaped handle 36 with the ends thereof pivotally coupled with side walls 26, 28 respectively adjacent rear wall 24. Stop switch 37 is mounted to handle 36. Front wall 22 includes four caster wheels 23*a*, 23*b*, 23*c*, and 23*d* (FIG. 8) mounted at the four corners thereof for rollably supporting apparatus 10 in the storage position shown in FIG. 1. Front wall 22 also includes two, spaced, front idler wheels 25*a* and 25*b* mounted on the outboard face thereof for rolling support of the front portion of apparatus 10 in the operating position as shown in FIGS. 2 and 9–11. Rear wall 24 includes two, spaced, rear idler wheels 27*a* and 27*b* mounted on shaft 29 on the outboard face thereof for rolling support of the rear portion of apparatus 10 in the operating position.

The inboard side of left side wall 26 includes inwardly extending and spring-biased, conically shaped, spaced, left guide wheels 31*a* and 31*b*. Similarly, the inboard side of right side wall 28 includes inwardly extending and spring-biased, conically shaped, spaced, right guide wheels 37*a* and 37*b*. Guide wheels 31*a,b* and 37*a,b* are positioned to engage the respective gutter inboard surfaces of a bowling lane in order to keep apparatus 10 centered thereon.

The outboard side of left side wall 26 includes spaced, transition casters 38*a* and 38*b*, and the outboard side of right side wall 28 includes spaced, transition casters 39*a* and 39*b*. Casters 38*a,b* and 39*a,b* are positioned to elevate the lower side of apparatus 10 during movement between lanes while in the operating position, and are spaced greater than the width of the lane surface so that they ride in the gutter areas thereby allowing the operating components of apparatus 10 to engage the lane surface.

Figure 7:
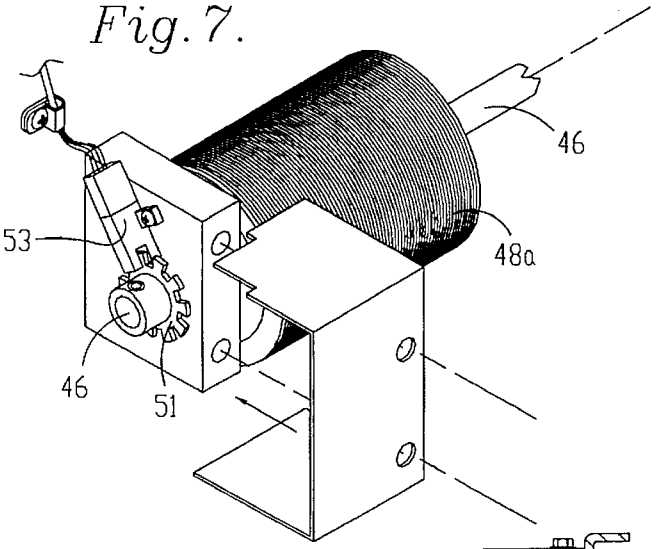
FIG. 7 is a partial perspective view of the preferred tachometer assembly of the apparatus of FIG. 1.

Drive system 14 includes variable speed, drive motor 40 (Bison 130VDC Model 011-300-9198) with drive sprocket 42 mounted on motor shaft 44 (FIG. 9), and includes drive shaft 46 (FIG. 1) extending transversely between left and right walls 26, 28 with drive wheels 48*a* and 48*b* mounted adjacent the ends thereof. Driven sprocket 50 is coupled with drive shaft 46 and aligned with drive sprocket 42. Chain 52 interconnects sprockets 42 and 50. Notched counter wheel 51 (FIG. 7) is coupled with the left end of shaft 46. Photoelectric speed sensor 53 senses the rotation of wheel 51. The same type of sensor assembly used for lane distance sensor 55 (FIG. 12) is coupled with the right end of shaft 29 for indicating the distance of travel of apparatus 10.

Figure 8:
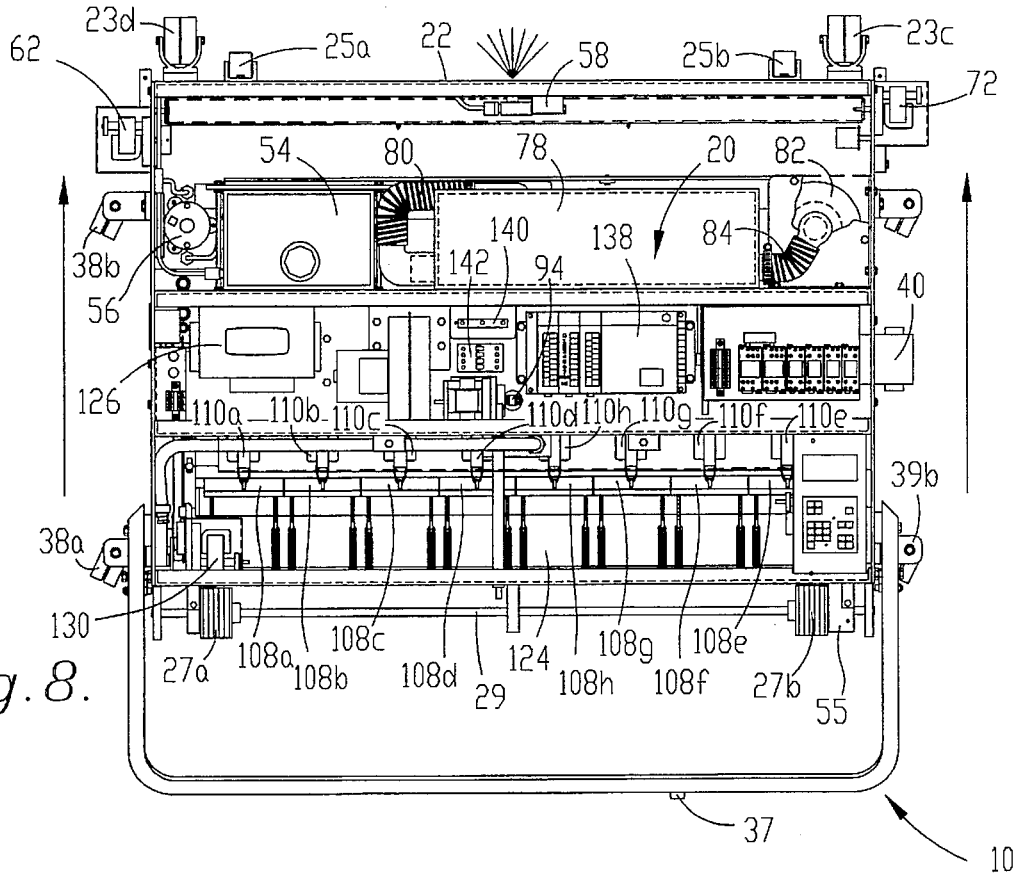
FIG. 8 is a plan view with doors removed of the apparatus of FIG. 1 showing all of the wicks engaged with the transfer roller.

Referring to FIGS. 2 and 8, cleaning assembly 16 includes cleaning solution tank 54, cleaning solution pump 56 coupled with tank 54 for receiving cleaning solution therefrom, and spray nozzle 58 coupled with pump 56 for receiving cleaning solution therefrom. Nozzle 58 is centrally mounted to front wall 22 for spraying cleaning solution onto the surface of a bowling lane ahead of front wall 22.

Cleaning assembly 16 also includes cloth feed roll 60 with unwind motor 62 (FIG. 8) attached to the left end thereof, duster roller 64 pivotally mounted for up and down movement by pivot arms 66, guide roller 68, and take-up roller 70 with take-up motor 72 attached to the right end thereof. A roll of cleaning cloth 74 is placed on feed roll 60, extends around duster roller 64 and guide roller 68 to take-up roller 70. When unwind motor 62 is activated, feed roller 62 rotates and produces slack in cloth 74 in the direction of the arrows in FIG. 2. This slack allows duster roller 64 to pivot downwardly about pivot arm 66 to engage the bowling lane surface and to operate normally closed limit switch 75. Activation of take-up motor 72 rotates take-up roller 70 and removes the slack in cloth 74 is removed and pivot arms 66 allow duster roller 64 to pivot upwardly out of contact with the bowling lane surface.

Pivot arm 66 engages and activates fail safe switch 73 if duster roller 64 drops below the plane of the bowling lane surface. This might occur, for example, if apparatus 10 travels into the pin area and roller 64 drops off the end of the lane. As explained further herein, activation of switch 73 stops apparatus 10.

Referring to FIGS. 1, 2 and 8, cleaning assembly 16 further includes squeegee mechanism 76, tank 78 for storing spent cleaning solution, hose 80 innerconnecting squeegee mechanism 76 and tank 78, and vacuum pump 82 innerconnected with tank 78 by hose 84. Squeegee mechanism 76 includes spaced, resilient squeegees 86*a* and 86*b*, squeegee holder 88, spaced, pivot arms 90*a* and 90*b*, support rod 92, operating arm 94 and squeegee motor 96.

Squeegees 86*a,b* are positioned transversely within apparatus 10 and are long enough to span the width of a bowling lane. Holder 88 supports squeegees a,b in the spaced relationship illustrated and is coupled with the forward ends of pivot arms 90*a,b*, while support rod 92 engages and supports the opposed ends of pivot arms 90*a,b*. Drive shaft 46 extends centrally through pivot arms 90*a,b* in order to allow arms 90*a,b* to pivot thereabout. Operating arm 94 couples squeegee motor 96 with support rod 92. Arm 94 is coupled with motor 96 in a conventional offset cam arrangement so that rotation of motor 96 in one direction lifts rod 92 thereby pivoting squeegees 86*a,b* into contact with the bowling lane surface and operating normally open, squeegee down switch 95. Rotation of motor 96 in the opposite direction shifts rod 92 downwardly in order to pivot squeegees 86*a,b* upwardly out of contact with the lane surface and to operate normally-open squeegee up switch 97.

Finally, cleaning assembly 16 includes blower 98 which exhausts through opening 100 behind squeegees 86*a,b*. When operated, the exhaust air from blower 98 dries any residual moisture that may remain on the bowling lane surface as a result of the cleaning operation.

FIGS. 1–3 and 8 illustrate lane dressing assembly 18 which includes liquid lane dressing storage tank 102, pump 104, wick reservoir 106, wicks 108 (individually designated as 108*a*, 108*b*, 108*c*, 108*d*, 108*e*, 108*f*, 108*g* and 108*h*) and wick actuators 110 (individually designated as 110*a*, 110*b*, 110*c*, 110*d*, 110*e*, 110*f*, 110*g* and 110*h*). Pipe 112 connects tank 102 with the inlet of pump 104 for reception of lane dressing from tank 102. Pipe 114 connects the outlet of pump 104 with wick reservoir 106 for delivery of lane dressing thereto.

Wick reservoir 106 includes overflow outlet 116 which is positioned at the selected level of lane dressing in reservoir 106. Overflow pipe 118 connects outlet 116 with tank 102 for recycling. Pump 104 is operated to add lane dressing to reservoir 106 at a rate that exceeds the maximum application rate to the bowling lane in order to maintain a constant overflow through outlet 116. In this way, maintenance of the selected level in reservoir 106 is assured. Maintenance of a selected level in reservoir 106 has been a particular problem in the prior art leading to variations in wick absorption and transfer rates, which in turn has led to erratic application of lane dressing to the bowling lane. Those skilled in the art will appreciate that the level control of the present invention as described above solves this prior art problem.

Figure 4:
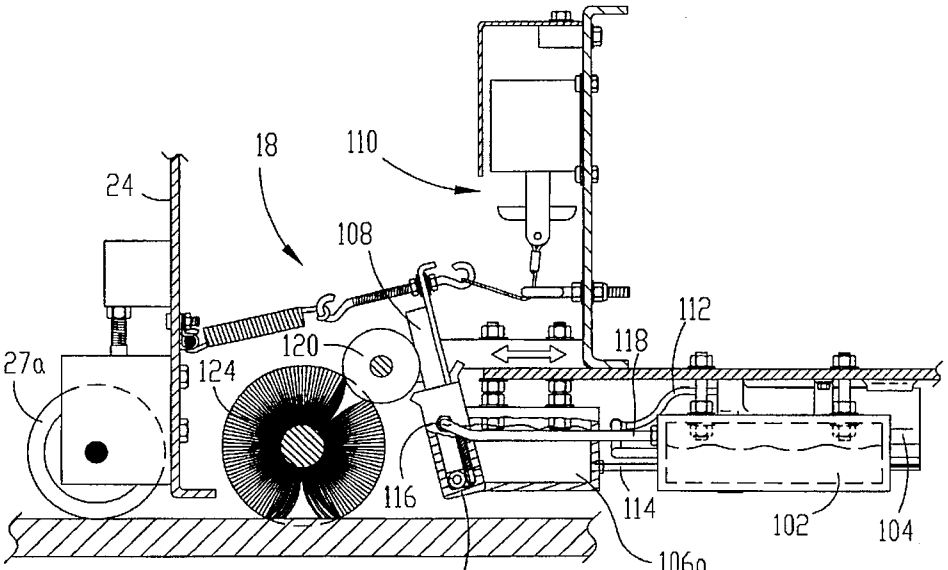
FIG. 4 is another embodiment of the assembly of FIG. 3.

FIG. 4 illustrates a second embodiment for liquid level control. This embodiment is similar to that in FIG. 3 except for the addition of wick reservoir extension 106*a* which increases the storage volume of the wick reservoir for increased stability of liquid level.

Figure 3:
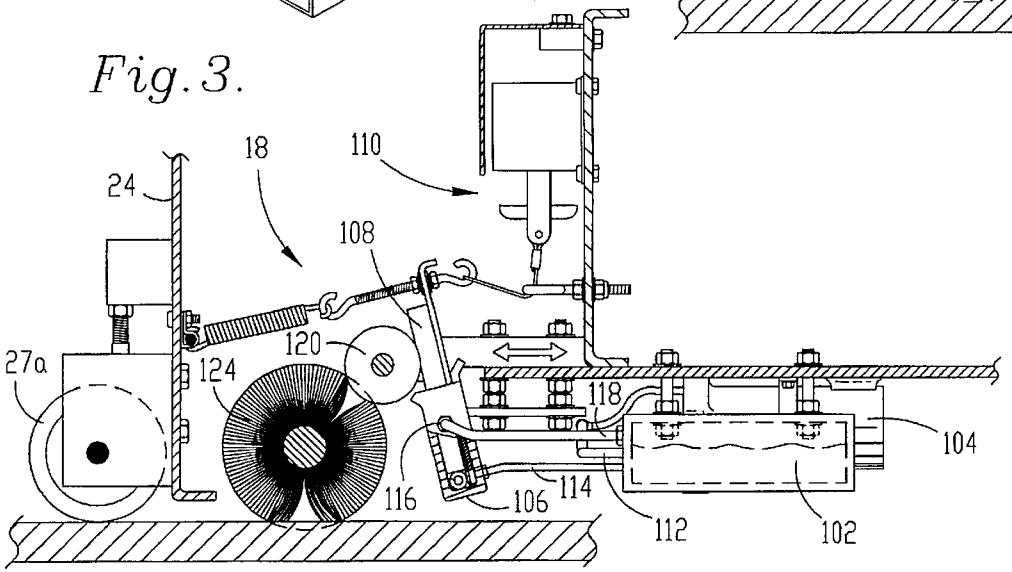
FIG. 3 is a partial sectional view of the apparatus of FIG. 1 showing one embodiment of the lane dressing application assembly.
Figure 6:
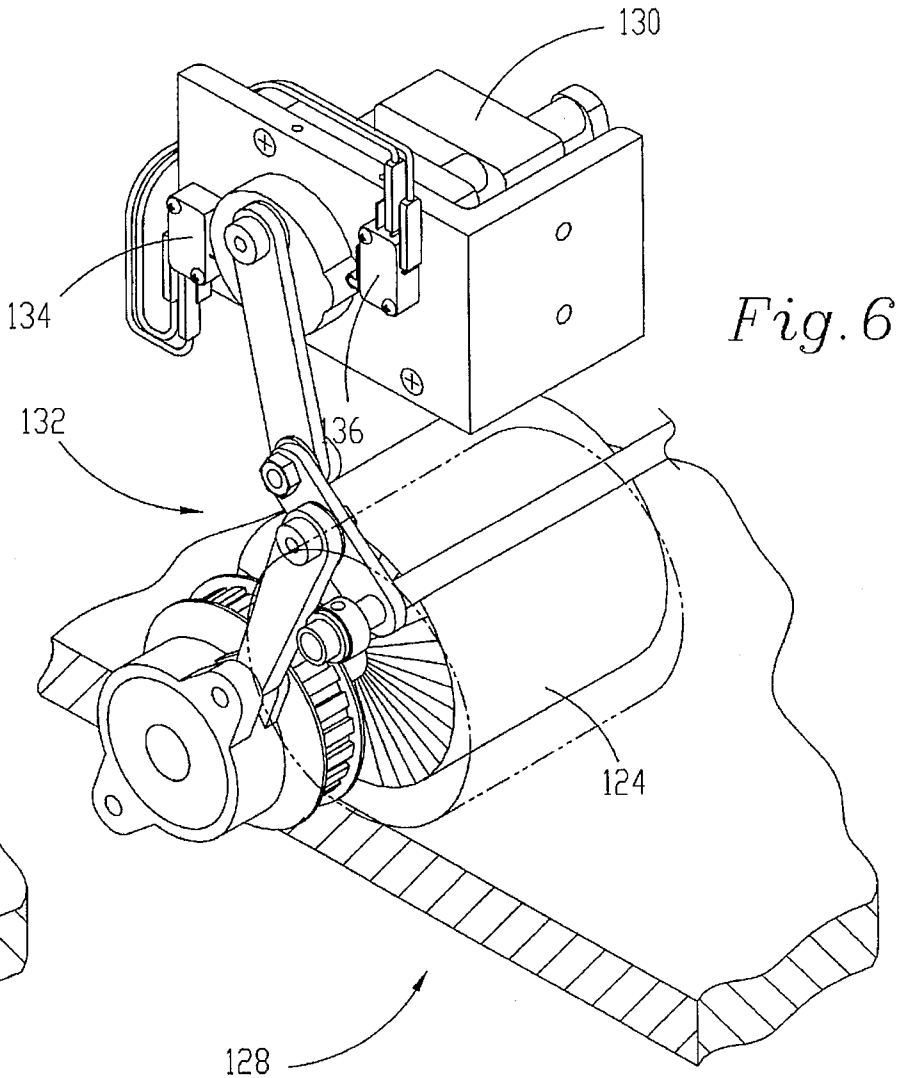
FIG. 6 is a partial perspective view of the mechanism of FIG. 5 showing the buffer roller in the up position.
Figure 5:
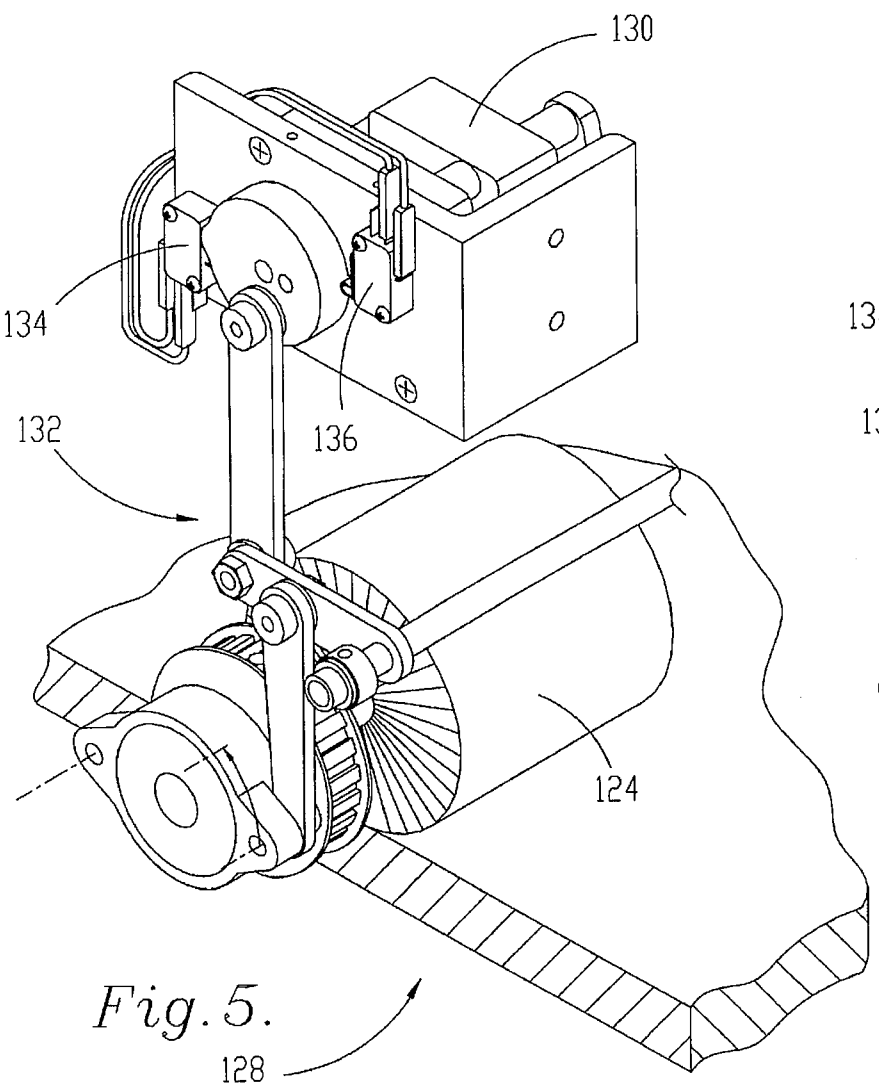
FIG. 5 is a partial perspective view of the mechanism for shifting the buffer roller showing the roller in the down position.

Lane dressing assembly 18 also includes transfer roller 120 coupled with transfer motor 122, buffer roller 124 coupled with buffer motor 126, and buffer shifting mechanism 128 (FIGS. 5 and 6). Transfer roller 120 is positioned to receive lane dressing from wicks 108 when in the engaged position as illustrated in FIGS. 3 and 4, for example. Buffer roller 124 is positioned to engage transfer roller 120 in order to receive lane dressing therefrom and to apply lane dressing so received to the surface of the bowling lane.

Shifting mechanism 128 shifts buffer roller 124 between a lane contact position as shown in FIG. 5 and a disengaged position as shown in FIG. 6. Mechanism 128 includes buffer shifting motor 130 coupled with buffer roller 124 by way of cam linkage 132 as illustrated in FIGS. 5 and 6. Operation of shifting motor 130 in one direction places buffer roller 124 in the lane contact position and activates normally open, buffer down switch 134. Operation of motor 130 in the other direction shifts roller 124 to the disengaged position and activates normally-open, buffer-up switch 136. Shifting mechanism 128 and components 108, 110 and 116-122 along with other components are conventional in nature as illustrated in U.S. Pat. No. 4,980,815 incorporated herein by reference.

Figure 12A:
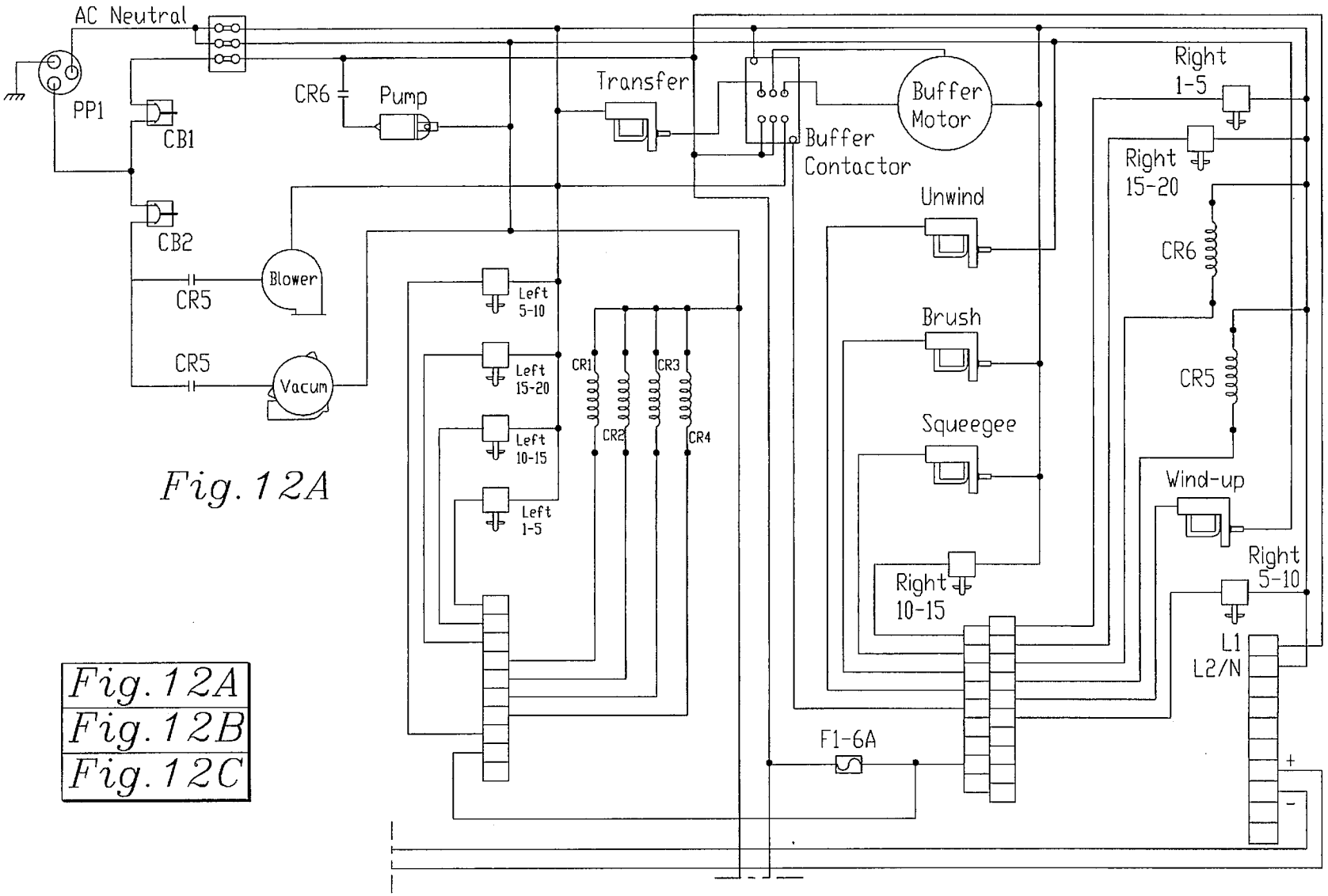
FIGS. 12A–C are an electrical schematic diagram of the apparatus of FIG. 1.
Figures 12B, 12C:
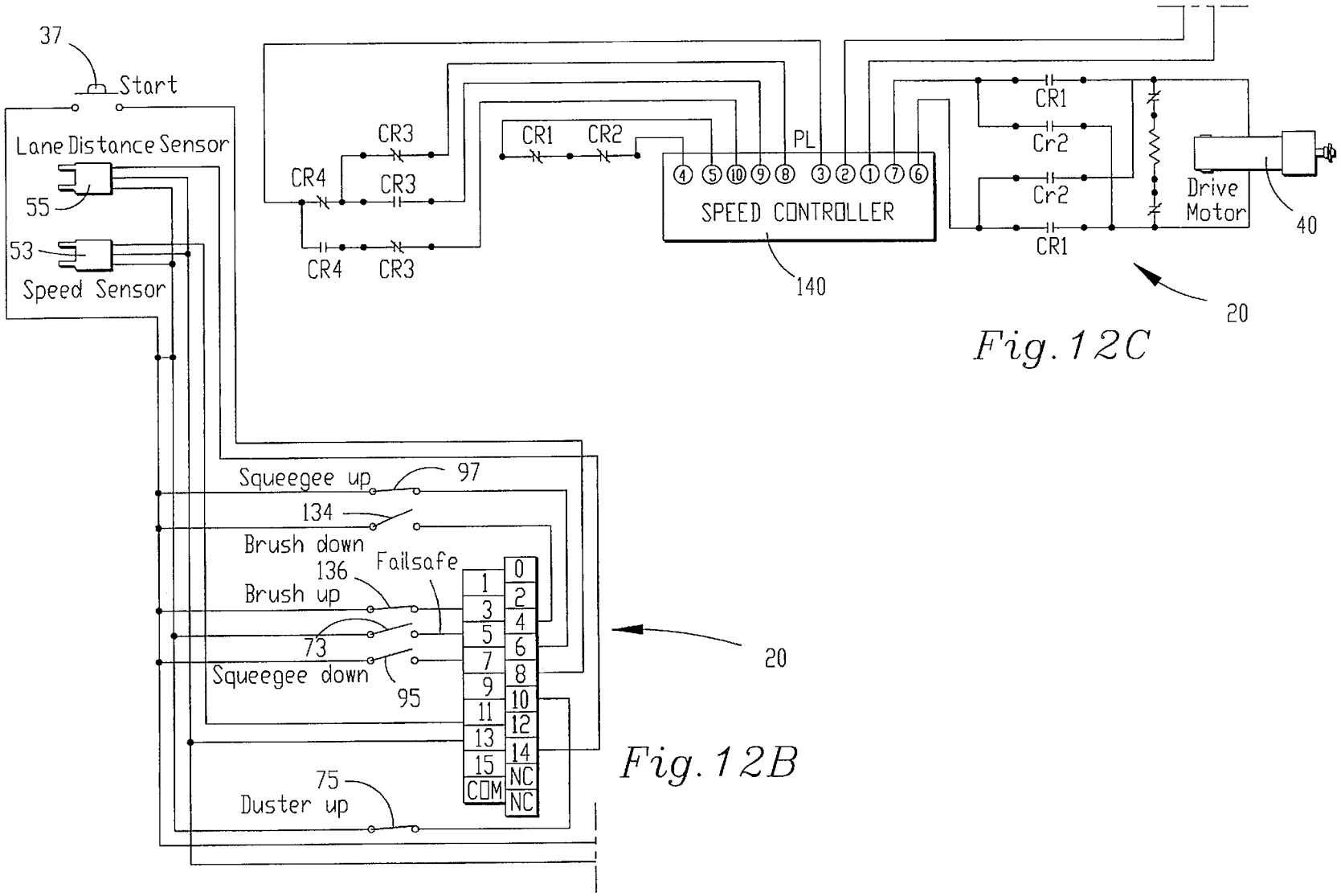

FIG. 12 illustrates control system 20 which includes programmable logic controller (PLC) 138 (see FIG. 8) (OMROM Model C200HS), speed controller 140 (K&B Electronics Model KBIC), contactor 142 and control relays CR1, CR2, CR3, CR4, CR5 and CR6. Connections to PLC 138 are designated by the manufacturer's terminal number. Additionally, PLC 138 is under control of a program stored in internal memory and illustrated by the ladder diagrams of the microfiche appendix included as part of the disclosure hereof. The program controls PLC 138 and includes various options and customized lane maintenance schemes such as cleaning frequency, the frequency of lane dressing application, and the desired lane dressing patterns.

In the preferred embodiment, speed controller 140 operates drive motor 40 at three selectable speeds: low speed at 20 inches/second, second speed at 30 inches/second, and high speed at 60 inches/second. These speeds are individually adjustable by potentiometers of speed controller 140.

Operation

As described above, apparatus 10 is operable for performing maintenance operations on the surface of a bowling lane including cleaning and the application of lane dressing (oiling). In operation, the user accesses PLC 138 and enters the first and last lanes to be maintained and then pushes the start key on PLC 138. The user then positions apparatus 10 about 6 inches behind the foul line of the first lane and presses start switch 37. In response, PLC 138 checks the current date, time of day, the current lane and accesses the corresponding maintenance scheme from the program memory. The maintenance scheme may include cleaning only, application of lane dressing only, or both for a particular lane.

Figure 9:
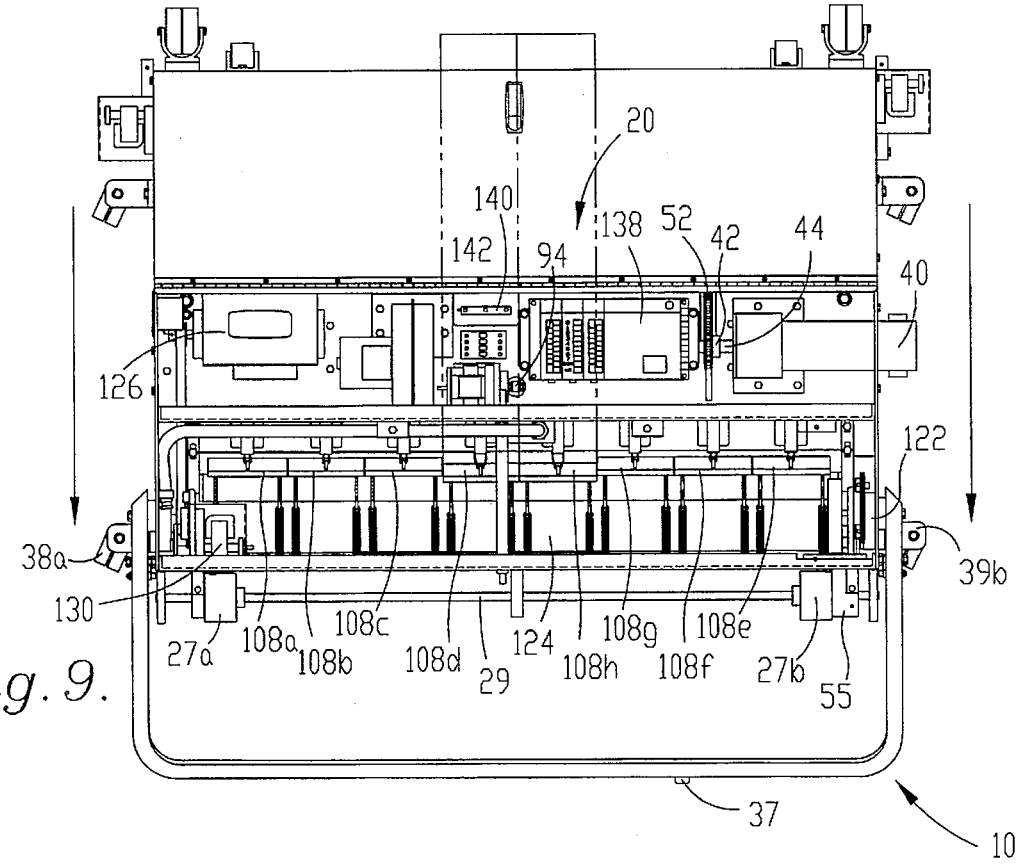
FIG. 9 is a plan view similar to FIG. 8 showing only the two center wicks engaged with the transfer roller for the first portion of an exemplary lane dressing pattern.
Figure 10:
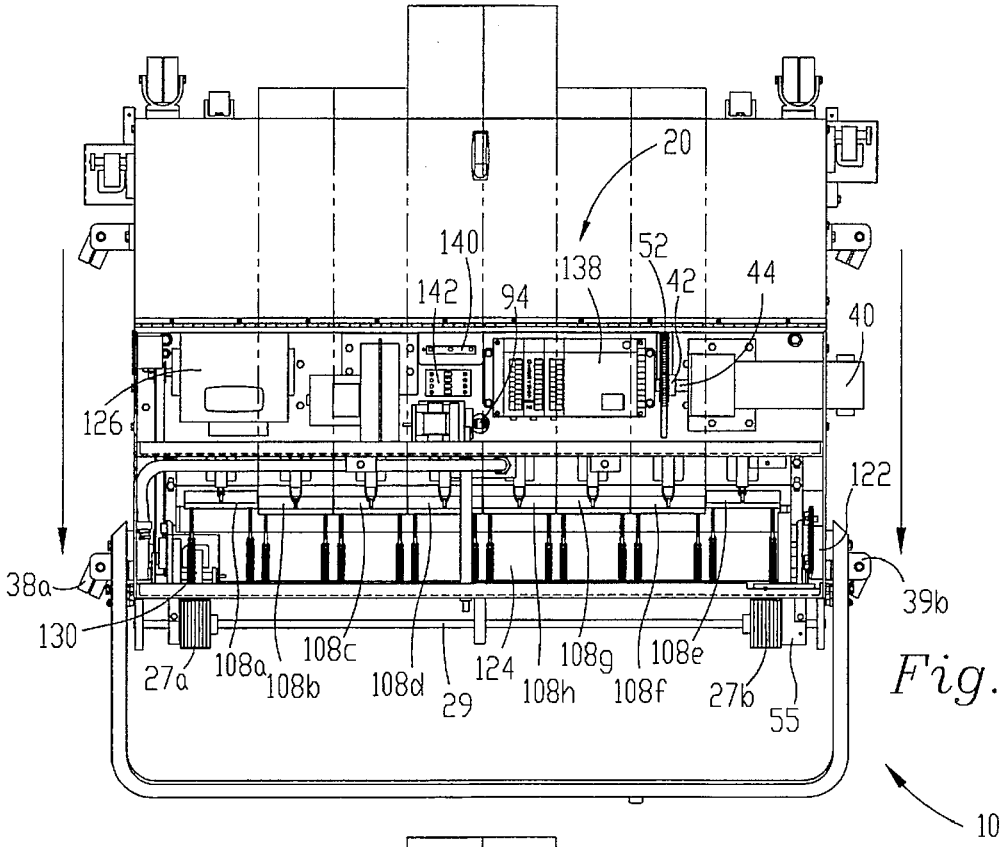
FIG. 10 is a view similar to FIG. 9 showing additional four wicks engaged with the transfer roller for producing a second portion of the lane dressing pattern.
Figure 11:
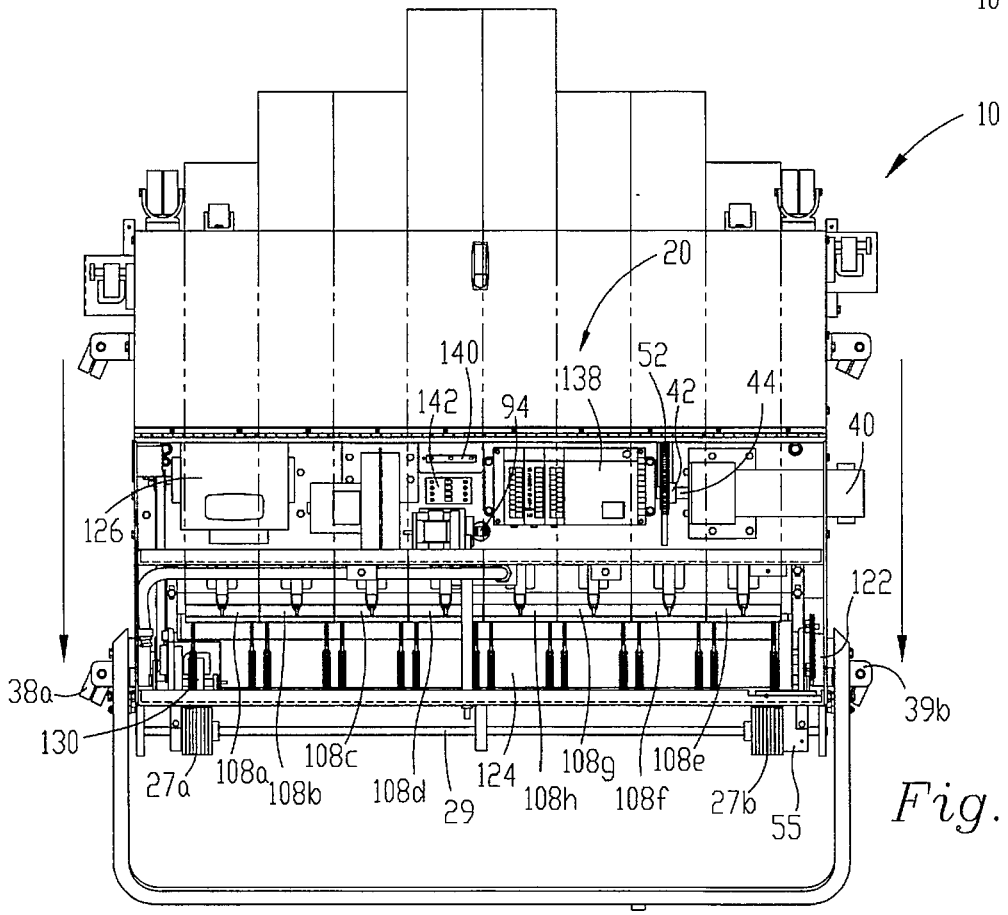
FIG. 11 is a view similar to FIG. 10 showing the additional two outer wicks engaged with the transfer roller to produce a third portion of the lane dressing pattern.

By way of example, the selected scheme is for cleaning the entire lane and for applying lane dressing according to the pattern illustrated in FIGS. 9–11. In preferred operation, apparatus 10 performs cleaning and lane dressing operations during the forward pass from the foul line toward the pins and performs lane dressing applications on the return pass from the pins toward the foul line.

Initially PLC 138 activates output 203 which energizes squeegee motor 96 to the down position. When squeegee down switch 134 is activated, motor 96 turns off. Next, PLC 138 activates output 204 which energizes unwind motor 62 until a programmed unwind time is reached and then shuts off. This allows duster roller 64 to engage the lane surface. PLC 138 then activates output 206 to energize relay CR5 and turns on blower 98 and vacuum pump 82. The user then pushes apparatus 10 onto the bowling lane and again pushes start button 37.

PLC 138 responds by activating output 103 to energize forward relay CR1 having contacts coupled with speed controller 140 which responds by energizing drive motor 40 in the forward direction at low speed. During the travel of apparatus 10 along the bowling lane, travel distance is indicated by lane distance sensor 55 which provides its input to PLC 138 at input 14.

When a travel of 12 inches is reached, PLC output 105 energizes relay CR3. Speed controller 140 responds by increasing the speed of drive motor 40 to the second speed at 30 inches/second. This speed is chosen as the maximum which still allows for thorough cleaning of the lane and proper application of lane dressing.

Next, PLC output 204 energizes relay CR6 which in turn activates cleaning solution pump 56 whereupon cleaning solution is sprayed from nozzle 58. Output 204 toggles between on and off according to preset times set in the program.

As apparatus 10 travels forwardly along the lane toward the pins, cloth 74 engages the lane and cleans the surface of dirt and lane dressing. Squeegees 86*a,b* gather excess cleaning solution therebetween. Vacuum pump 82 induces an airflow between squeegees 86*a,b* which entrains the excess solution where it is delivered by way of hose 80 to tank 78. Internal baffles cause the entrained solution to collect in tank 78 and the airflow continues by way of hose 84 to vacuum pump 82.

Blower 98 exhausts air through opening 100 behind squeegees 86*a,b*. This action evaporates any residual moisture remaining on the lane surface.

Apparatus 10 continues the cleaning maintenance operation until the programmed distance is reached as indicated by lane distance sensor 55. It will be appreciated that the program can be configured to start and stop the cleaning maintenance operation at distances selected by the user according to the needs of the bowling center. When apparatus 10 reaches the selected cleaning distance, usually at the end of the lane, PLC outputs 103 and 105 turn off and speed controller 140 responds by stopping drive motor 40. In the event apparatus 10 fails to stop at the end of the lane, duster roller 64 drops and activates failsafe switch 73 (FIG. 1) to PLC input 5 whereupon PLC 138 responds by stopping drive motor 40. Output 203 next activates squeegee motor 96 to lift squeegees 86*a,b* from the lane as indicated by squeegee-up switch 97 connected to PLC input 3.

At the same time, PLC output 208 activates take up motor 72. This action rotates take up roller 70 which lifts duster roller 64. When duster-up switch 75 is engaged, PLC output 208 continues to operate motor 72 for a preset time, preferably 0.2 seconds in order to move a new section of cloth 74 into position on duster roller 64 for the next cleaning operation. This completes the cleaning operation with apparatus 10 stopped at the forward end of the lane.

If the maintenance scheme does not call for the application for lane dressing, then no maintenance need be performed on the return pass to the foul line. Accordingly, PLC output 104 energizes reverse relay CR2 and speed controller 140 responds by energizing drive motor 40 in the reverse direction at low speed. At this time the program in PLC 138 initiates various counters including a shift-to-high-speed counter, distance-to-foul-line counter, and shift-to-low-speed counter.

PLC 138 also de-energizes relay CR5 to turn off vacuum pump 82 for a selected time, preferably no less than about 4 seconds and no more than about 8 seconds. The spent cleaning solution stored in tank 78 tends to create foam because of the air turbulence and partial vacuum therein. Sometimes this foam is carried through to vacuum pump 82. Furthermore, the presence of the foam reduces the effective storage vacuum of tank 78 requiring that the operations of apparatus 10 be stopped in order to empty tank 78. This has been a problem in the prior art and has reduced the number of lanes that can be maintained between interruptions. By turning off vacuum pump 82 for the selected time during the return pass, the foam is allowed to settle thereby solving the prior art problem. It is preferred, however, to restart the vacuum pump after the selected time so that residual moisture in hose 80 does not drip onto the lane surface. The off time is selected so that pump 82 is restarted before apparatus 10 reaches the foul line.

When the count is complete on the shift to high speed counter, PLC 138 activates output 106 which energizes high speed relay CR4. Speed controller 140 responds by shifting drive motor 40 into high speed for the return pass to the foul line. At a speed of 60 inches per second, apparatus 10 rapidly returns to the foul line. During the course of a number of lanes, this saves considerable time and allows the maintenance operations to be completed for an entire bowling center in a manner that is more rapid and labor efficient than prior art machines.

When the count is complete on the distance to low speed counter, PLC output 106 turns off which deenergizes relay CR5 and speed controller 140 returns drive motor 42 to low speed. This occurs about no less than about 1 foot in front of the foul line so that the momentum of apparatus 10 traveling at high speed does not carry it beyond the foul line onto the lane apron.

When the count is complete on the distance-to-foul-line counter, PLC output 103 goes off, de-energizing relay CR1 whereupon speed controller 140 stops drive motor 40 at the foul line. PLC 138 notes completion of maintenance of the current lane and selects the next maintenance scheme including the initialization of the various internal counters and the like. The user then moves apparatus 10 into position on the next lane and presses the start button 37. If a separate application of lane dressing is to occur, apparatus 10 remains on the same lane in order to restart for the lane dressing application.

For lane dressing application, the desired pattern of lane dressing is stored in the memory of PLC 138 for the particular lane, for the particular day and time of day. With apparatus 10 in position on the apron behind the foul line, the user presses start button 37. PLC 138 activates output 205 which energizes buffer shifting motor 138 to lower buffer roller 124. When buffer roller 124 closes buffer-down switch 134 (provided as input to PLC input terminal 4), PLC 138 deactivates output 205.

At the same time, PLC 138 activates output 207 which energizes duster unwind motor 62 for a preset time in order to lower duster roller 64. Even if the cleaning operation is not to be performed, duster roller 64 is still lowered during applications of lane dressing to remove any dust or other debris ahead of buffer roller 124. The user then places apparatus 10 on the lane adjacent the foul line and activates start button 37 a second time. If cleaning is also performed during the forward pass, apparatus 10 also performs the cleaning operation as described above.

In response, PLC 138 activates relay CR1 and speed controller 140 responds by energizing drive motor 40 in the forward direction at low speed. At this time, PLC 138 activates output 209. This energizes buffer contactor 142 which responds by energizing buffer motor 126 and transfer motor 122. Additionally, PLC 138 initiates the various counters and timers for lane distance travel and the desired pattern of lane dressing to be applied to the lane. Next, PLC output 105 is activated to energize relay CR3 whereupon speed controller 140 energizes drive motor at the second speed. If the maintenance scheme requires only a light application of lane dressing, PLC 138 shifts drive motor 40 into high speed if the selected pattern can be achieved at this speed.

During travel along the lane, the program in PLC 138 energizes and de-energizes wick actuators 110*a–h* at the lane locations and for the times specified to achieve a selected pattern of lane dressing. As illustrated in FIG. 12, PLC outputs 100, 107, 101 and 102 respectively operate actuators 110*a–d* in order to engage and disengage wicks 108*a–d* respectively. Wicks 108*a–d* have a width and position corresponding to left bowling lane boards 1–5, 5–10, 10–15 and 15–20 respectively (numbering from the left of the lane). Similarly, PLC outputs 200, 210, 201 and 202 respectively operate actuators 110*e–h* in order to selectively engage and disengage wicks 108*e–h* respectively. Wicks 108*e–h* have a width and position corresponding to right bowling lane boards 1–5, 5–10, 10–15 and 15–20 (numbering from the right of the lane).

Just before the end of the travel for the selected application scheme, PLC 138 activates output 208 which energizes take up motor 72 to lift duster roller 64 from the lane before apparatus 10 stops. This prevents duster roller 64 from leaving a transverse line of debris on the lane, which may occur if apparatus 10 stops with roller 64 in contact with the lane. When the application of lane dressing is complete, PLC 138 turns off drive motor 40 and apparatus 10 stops.

Some application patterns require a heavy application of lane dressing at various locations on the lane. If such is the case, apparatus 10 is also operable for applying lane dressing on the return trip to the foul line in accordance with the selected scheme. FIGS. 9–11 illustrate the application of lane dressing on return to the foul line. The pattern illustrated requires the center of the lane to have a longer strip of lane dressing with progressively shorter strips toward the outside boards of the lane as measured from the foul line.

For the pattern of FIGS. 9–11, buffer roller 124 remains lowered and transfer motor 122 and buffer motor 126 remain energized. PLC outputs 104 and 106 activate to energize drive motor 40 in the reverse direction at high speed during the first portion of the return trip where no lane dressing application is required. Also, PLC 138 energizes actuators 110*a–h* which lifts wicks 108*a–h* from transfer roller 120 so that no lane dressing is applied to the lane.

At the selected travel distance for the beginning of the pattern as shown in FIG. 9, PLC 138 shifts drive motor 40 to the low speed and de-energizes actuators 110*d* and 110*h*. This allows wicks 108*d* and 108*h* to engage transfer roller 120 thereby transferring lane dressing to buffer roller 124 and onto the lane.

Transfer and buffer rollers 120, 124 continue to rotate at the same respective speeds thereby maintaining the same rate of lane dressing transfer. Motor 40, however, is propelling apparatus 10 at low speed. This enables a thicker application of lane dressing while maintaining precise control and uniformity. The prior art has attempted to achieve a thicker application by increasing the speed of the transfer roller while maintaining the same travel speed. This has lead to a lack of precise control and a lack of uniformity.

Next, as shown in FIG. 10, PLC 138 de-energizes actuators 110*b,c* and 110*f,g* whereupon wicks 108*b,c* and 108*f,g* engage transfer roller 120 to transfer lane dressing to buffer roller 124 for the pattern illustrated. Finally, FIG. 11 illustrates the final portion of this pattern in which PLC 138 de-energizes actuators 110*a* and 110*e* so that wicks 108*a* and 108*e* engage the transfer roller to achieve the final portion of the pattern. The wicks remain engaged until apparatus 10 reaches the foul line and stops.

Prior art machines also present another problem, especially during the forward pass when the desired pattern stops short of the pins. When the wicks lift from the transfer roller, residual lane dressing remains on the transfer roller and buffer roller. The residual lane dressing is applied to the lane in a decreasing longitudinal profile. It is desired that if any lane dressing is to be applied at all, then the amount applied should meet a certain minimum such as three units. The decreasing profile drops below this minimum after a few feet.

To solve this problem, the program in PLC 138 intermittently actuates wicks 108*a–h* for short time periods as measured by no more than 12 inches of lane travel after the end of the lane dressing pattern. After the end of the pattern, enough residual lane dressing is applied for a short distance to maintain the desired minimum. When the residual drops below this minimum, PLC 138 engages wicks 108*a–h* for no more than 12 inches of lane travel. This adds sufficient lane dressing to the transfer roller and buffer roller to maintain the minimum application level, usually to the end of the lane. If not, another residual amount may be added.

I claim:

1. A bowling lane maintenance apparatus comprising:

a housing;

maintenance means carried by said housing and operable for performing maintenance on a bowling lane as said apparatus is propelled therealong;

drive means coupled with said housing and operable for propelling said apparatus along a bowling lane at a plurality of selectable speeds; and control means coupled with said maintenance means for controlling the operation thereof and coupled with said drive means for controlling said drive means at a plurality of said selectable speeds during performance of said maintenance, said maintenance including cleaning, said maintenance means including means for performing said cleaning during forward movement of said apparatus, said control means including means for controlling said drive means at a first selected speed during said cleaning, and for controlling said drive means at a second selected speed, faster than said first selected speed, during rearward movement of said apparatus.

2. A bowling lane maintenance apparatus comprising:

a housing;

maintenance means carried by said housing and operable for performing maintenance on a bowling lane as said apparatus is propelled therealong;

drive means coupled with said housing and operable for propelling said apparatus along a bowling lane at plurality of selectable speeds; and control means coupled with said maintenance means for controlling the operation thereof and coupled with said drive means for controlling said drive means at a plurality of said selectable speeds during performance of said maintenance;

said maintenance including the application of lane dressing, said maintenance means including a rotatable transfer roller configured for receiving lane dressing from a source thereof and a rotatable applicator roller configured for receiving lane dressing from said transfer roller and for delivering lane dressing so received to the bowling lane, said apparatus including means for rotating said transfer and applicator rollers at respective rotation rates, said control means including means for controlling said maintenance and drive means for applying lane dressing at a first speed and at a second lower speed while said respective rotation rates of said rollers remain unchanged at said first and second speeds.

3. A bowling lane maintenance apparatus comprising:

a housing;

dressing means carried by said housing and operable for applying liquid lane dressing to a bowling lane as said apparatus is propelled along the bowling lane;

drive means coupled with said housing and operable for propelling said apparatus along the bowling lane; and control means coupled with said dressing and drive means for controlling the operation thereof, said dressing means including a lane dressing reservoir, applicator means operable for receiving lane dressing and applying lane dressing so received to the bowling lane, at least one dressing-absorbent wick having a reservoir portion received in said reservoir for absorbing lane dressing therefrom and having an applicator portion for engaging said applicator means for transferring absorbed lane dressing thereto, and level means for maintaining a selected level in said reservoir, said level means including structure defining an overflow outlet in said reservoir, and adding means for adding lane dressing to said reservoir at a rate sufficient for maintaining lane dressing overflow through said outlet thereby maintaining said selected level as the level of said overflow.

4. The apparatus as set forth in claim 3, said level means including a storage tank for receiving lane dressing from said overflow outlet, said adding means including a pump coupled with said tank for receiving lane dressing therefrom and for delivering lane dressing to said reservoir at said rate.

5. A bowling lane maintenance apparatus comprising:

a housing;

cleaning means carried by said housing and operable for cleaning a bowling lane using a cleaning liquid applied to the lane as said apparatus travels therealong;

drive means coupled with said housing and operable for propelling said apparatus along the bowling lane; and control means coupled with said cleaning and drive means and operable for controlling the operation thereof, said cleaning means including removal means for removing cleaning liquid from the bowling lane, said removal means including a tank for storing removed cleaning liquid, and a vacuum pump fluidically coupled with said tank and operable for producing a partial vacuum in said removal means for inducing air flow therethrough, the removed cleaning liquid being subject to foaming in said tank thereby reducing the effective storage volume thereof, said control means including means for stopping operation of said vacuum pump for a selected time to allow said foaming to settle and then for restarting said vacuum pump after said selected time.

6. The apparatus as set forth in claim 5, said selected time being between about 4 and 8 seconds.

7. The apparatus as set forth in claim 5, said control means being operable for stopping said vacuum pump for selected time after completion of said cleaning and for restarting said vacuum pump while said apparatus is still traveling on the bowling lane.

8. A bowling lane maintenance apparatus comprising:

a housing;

dressing means carried by said housing and operable for applying liquid lane dressing to a bowling lane as said apparatus is propelled along the bowling lane;

drive means coupled with said housing and operable for propelling said apparatus along the bowling lane; and control means coupled with said dressing and drive means for controlling the operation thereof, said dressing means including applicator means operable for receiving lane dressing from a source thereof and applying lane dressing so received to the bowling lane, and lane dressing supply means for selectably supplying lane dressing to said applicator means for creating a pattern of lane dressing on the lane and for discontinuing supply of lane dressing after completion of said pattern, said applicator means being subject to retaining a residual of lane dressing after completion of the lane dressing pattern and subject to applying said residual to the bowling lane in a gradually decreasing configuration, said control means including means for supplying lane dressing to said applicator means during less than twelve inches of travel of said apparatus after completion of said pattern.

* * * * *